US005213139A

United States Patent [19]

Deuel et al.

[11] Patent Number: 5,213,139

[45] Date of Patent: May 25, 1993

[54] TOOL FOR FLATTENING A CABLE

[75] Inventors: Gregory F. Deuel, Manheim; Kenneth F. Folk, Harrisburg, both of Pa.

[73] Assignee: Amp Incorporated, Harrisburg, Pa.

[21] Appl. No.: 827,670

[22] Filed: Jan. 29, 1992

[51] Int. Cl.[5] ..... B21F 01/02

[52] U.S. Cl. ..... 140/147; 72/211

[58] Field of Search ..... 72/211; 140/52, 106, 140/123, 147

[56] References Cited

U.S. PATENT DOCUMENTS 1,824,219 9/1931 Loveless ..... 140/106
2,826,105 3/1958 Gardner ..... 72/211
3,199,549 8/1965 Wallshein ..... 140/106
3,747,648 7/1973 Bauer ..... 140/147
5,064,386 11/1991 Dale et al. ..... 439/535

*Primary Examiner*—Lowell A. Larson
*Attorney, Agent, or Firm*—James M. Trygg; Robert J. Kapalka

[57] ABSTRACT

The present invention is a hand operated tool for flattening a portion of a ribbon cable preparatory to installing a cable tap. The tool includes a set of rollers which are closeable upon the cable. The rollers are then rotated, first in one direction and then the other while varying the pressure on the rollers to effect removal of kinks and to generally flatten a portion of the cable.

6 Claims, 6 Drawing Sheets

TOOL FOR FLATTENING A CABLE

The present invention relates to a tool for flattening a portion of multi-conductor ribbon cable preparatory to attaching a cable tap.

BACKGROUND OF THE INVENTION

So called intelligent wiring systems are becoming more popular in light frame structures, such as single and multi-family dwellings. These intelligent wiring systems generally include a ribbon cable, comprising both power conductors and data or signal conductors, which is routed to various terminal points within the structure. Terminal boxes are installed at these points including a connector which is electrically connected to the conductors of the ribbon cable. Such a system is disclosed in U.S. Pat. No. 5,064,386 which issued Nov. 12, 1991 to James L. Dale et al, and is incorporated by reference as though set forth verbatim herein. As shown in FIGS. 1 and 2, a ribbon cable 10 is disposed behind a wall 12 adjacent a terminal point opening 14. A connector consisting of a cable tap 16 and a clamp member 18 is attached to the cable 10 in the position shown in FIG. 2 . Insulation displacement contacts 20 projecting from the cable tap 16 electrically engage the conductors of the ribbon cable 10. The cable tap 16 and clamp member 18 are arranged with the cable sandwiched in between and then pressed together with a hand tool until the insulation displacement contacts are fully inserted and the two parts snap together as described in the above mentioned '386 patent. In order for this to occur, the ribbon cable 10 must be substantially flat in the area where the cable tap 16 is to be applied. However, experience has shown that these cables undergo substantial bending and manipulation during installation resulting in numerous kinks as shown at 22 in FIG. 1 . While the relatively small gage data conductors in the ribbon cable 10 can easily be flattened by hand, the larger gage power carrying conductors are simply too stiff for this.

What at is needed is a hand tool that is easily operated that is effective in removing these kinks and flattening the cable in a selected area.

DESCRIPTION OF THE PREFERRED EMBODIMENT

Figure 3:
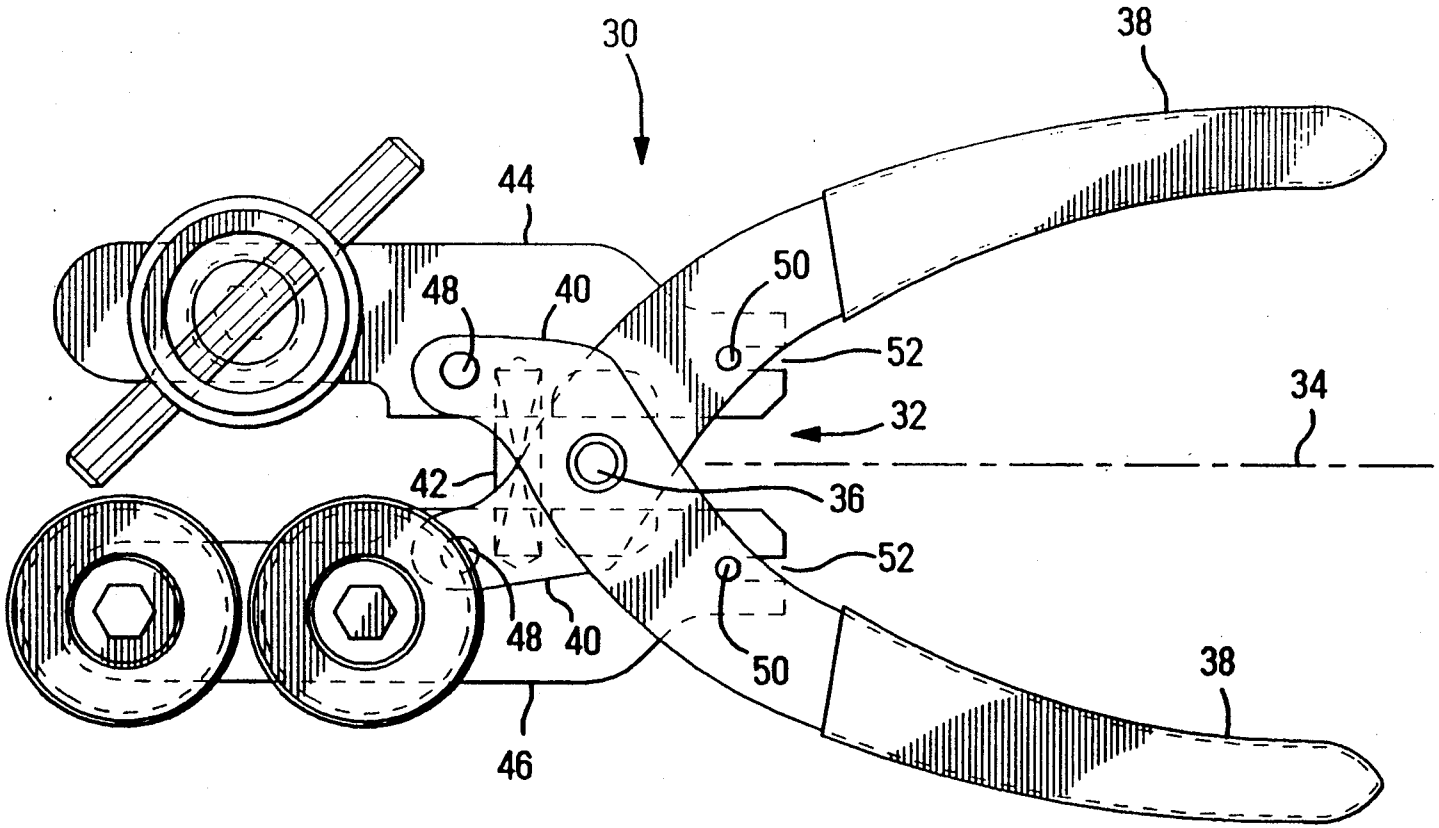
FIG. 3 is a plan view of a tool for flattening a cable according to the invention.

There is shown in FIG. 3 a tool 30 having a pair of plier-like members 32 having a longitudinal axis 34 and being mutually pivotally attached by means of a pair of rivets 36. A pair of substantially identical handles 38 extend in a direction generally along the axis 34 and a pair of mutually opposed mounting elements 40 extend in the opposite direction. An upper frame member 44 and lower frame member 46 are coupled to the mounting elements 40 by means of a pair of pins 48 and another pair of pins 50. The pins 48 allow for pivotal movement between the frame members 44 and 46 and their respective mounting element 40 while the pins 50 are rigid with respect thereto. Each frame member 44 and 46 includes an open-ended slot 52 having walls that straddle the respective pin 50 as shown. The slots 52 are sized to provide a slip fit with the pins 50 so that as the two handles 38 are caused to move toward the axis 34, the two pins 48 and the two pins 50 also move toward the axis 34 and the pins 50 slide in their respective slots 52 to the closed position shown in FIG. 5. This permits the frame members 44 and 46 to remain substantially parallel during manipulation of the handles 38 between the open and closed positions of FIGS. 3 and 5 respectively. It will be understood that other structures that do not result in parallel movement of the frame members may be advantageously utilized in the practice of the present invention. Each frame member 44 and 46 includes a blind hole, which holes are in alignment and contain a compression spring 42 for urging the mounting elements and handles 38 apart to their open position as shown in FIG. 3.

Figure 4:
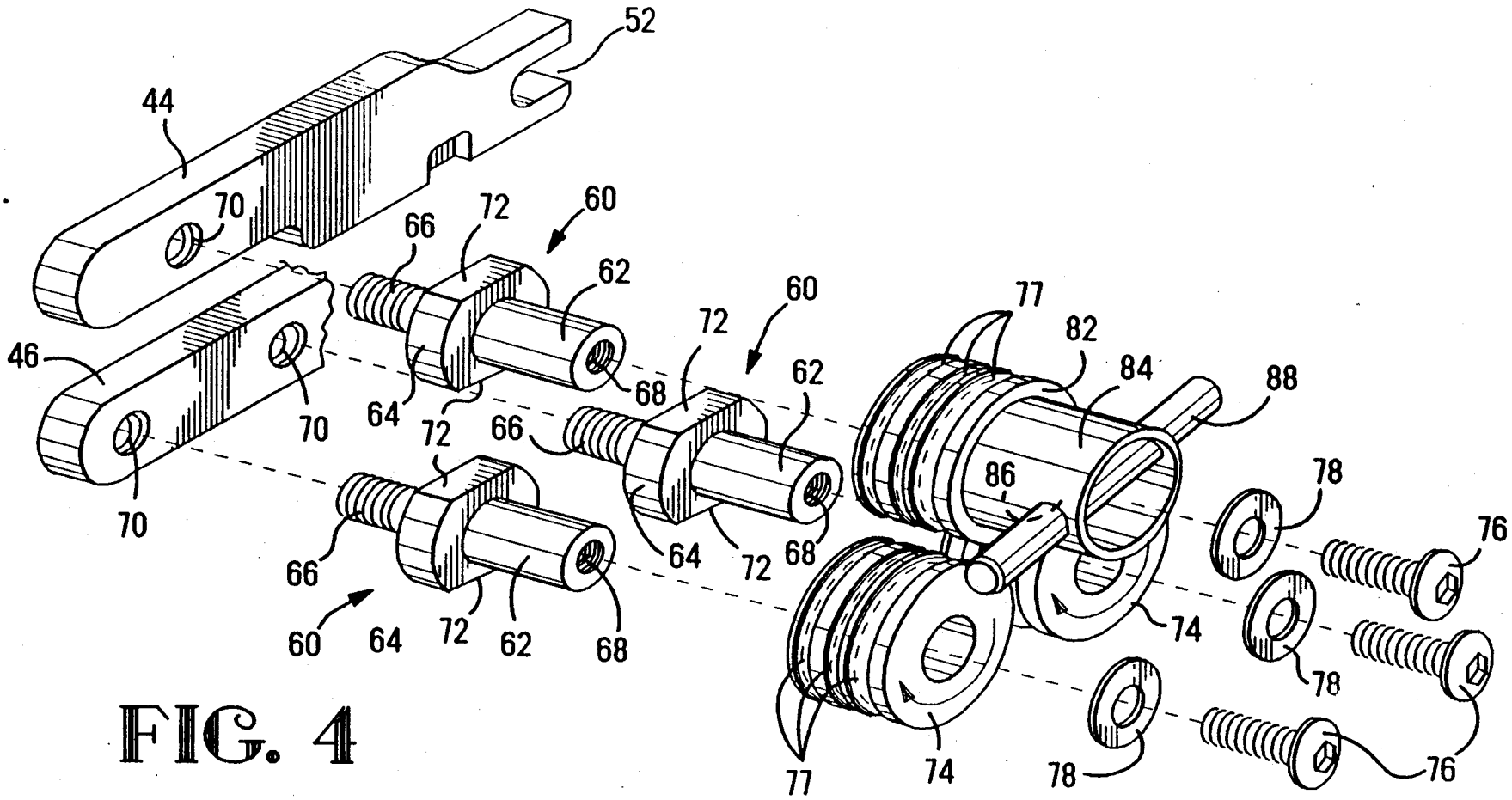
FIG. 4 is an exploded isometric view of a cable flattening mechanism for the tool according to the invention.
Figure 5:
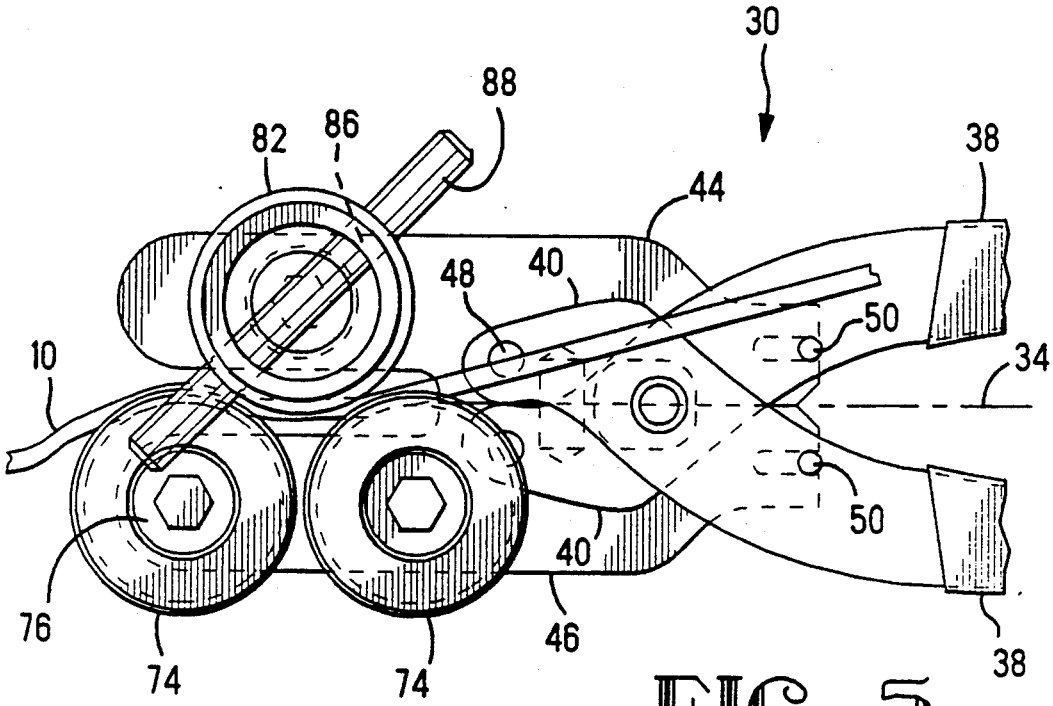
FIG. 5 is a plan view of the tool in a closed position, and a ribbon cable being flattened therein.

There is shown in FIG. 4 an exploded parts view of the cable flattening mechanism of the tool 30. There are three substantially identical studs 60 each of which includes an axle 62, a flange 64 and a threaded shank 66. A threaded hole 68 is formed in the end of each axle 62 for a purpose that will be explained below. A pair of threaded holes 70 are formed in the lower frame member 46 for receiving the threaded shanks 66 of two of the studs 60. Another threaded hole 70 is formed in the upper frame member 44 for receiving the shank of the third stud 60. This third stud 60 is positioned so that when the tool 30 is in its closed position, as shown in FIG. 5, the third stud is substantially equidistant from the two studs 60 in the lower frame member 46. A pair of wrench flats 72 are formed on the flanges 64 to aid in tightly threading the shanks 66 into their respective holes 70.

Figure 6:
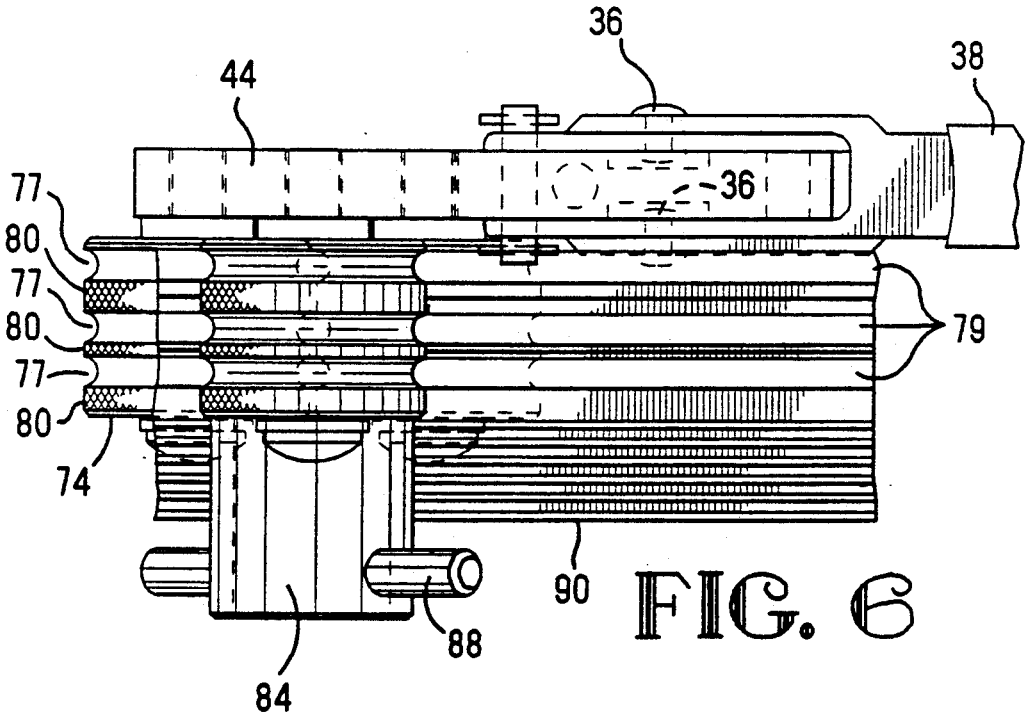
FIG. 6 is a top view of the tool of FIG. 5, without the ribbon cable.

A pair of substantially identical rollers 74 are journaled for rotation on the axles 62 of the two studs 60 attached to the lower frame member 46, as shown in FIGS. 3 and 4. The rollers 74 are held captive on the studs 60 by means of screw fasteners 76 being tightly threaded into the holes 68 and the washers 78 having a diameter larger than the diameter of the axles 62. The length of each axle is just slightly more than the length of the rollers 74 so that the rollers turn freely on their axles without excessive end play. The rollers 74 include a plurality of grooves 77 formed in their outer surfaces, as shown in FIGS. 4 and 6, that correspond to the large gage conductors 79 of the ribbon cable 10 shown in FIGS. 1 and 6. The grooves 77 have a depth and spacing that corresponds to the diameter and spacing of the conductors 79. The outer surface 80 of the rollers 74 forms lands that align with and will engage flat areas of the cable 10 that lie between the conductors 79 and that are adjacent thereto. A third roller 82 is journaled for rotation on the axle 62 of the stud 60 attached to the upper frame member 44, as shown in FIGS. 3, 4, and 6. The third roller 82 is held captive to its stud 60 by means of the screw 76 and washer 78 in a manner similar to that of the two rollers 74. Similarly the third roller 82 includes a plurality of grooves 77 which are identical in size, shape, and spacing to the grooves in the rollers 74, all of which are in mutual alignment. The third roller 82 includes a hub 84 which extends outwardly from the roller 82 in a direction away from the upper frame member 44. The hub 84 has a hole 86 formed therethrough adjacent its free end which contains a pin 88 which extends outwardly from each side of the hub 84. The hub 84 extends outwardly a distance sufficient so that the pin 88 will clear the outer most edge 90 of the cable 10, as best seen in FIG. 6. The purpose of the hub and pin is to provide a means for rotating the third roller 82 by manually grasping and twisting the hub and pin. It will be appreciated by those skilled in the art that the hub 84 could include any projection on its outer surface to facilitate manual gripping, the pin and hole arrangement being an example of such a projection.

Figure 7:
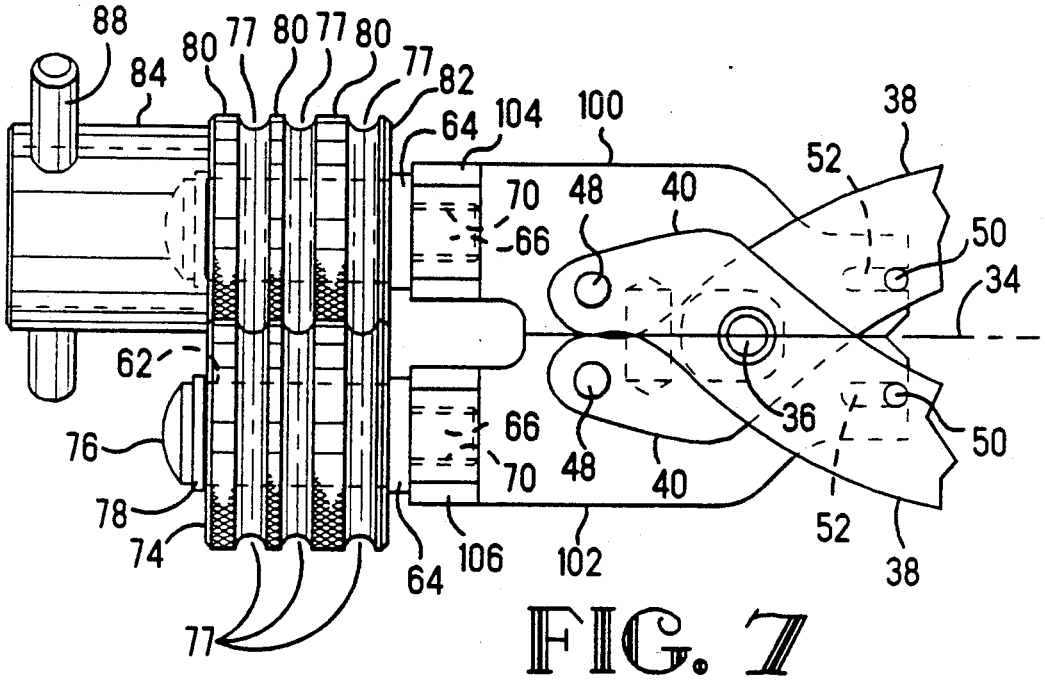
FIG. 7 is a plan view of an alternate embodiment of the tool wherein rollers of the tool have axes of rotation that are substantially parallel to a longitudinal axis of the tool.
Figure 8:
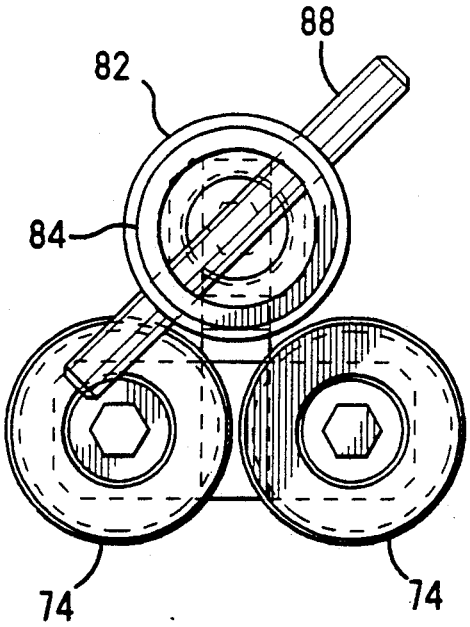
FIG. 8 illustrates the tool as viewed from the left-hand side of FIG. 7.

A second embodiment of the present invention is shown in FIGS. 7 and 8 where similar parts have similar identifying numbers. The main difference in this embodiment is that the rotational axis of the rollers 74 and 82 are substantially parallel with the axis 34 while in the first embodiment they are perpendicular. An upper frame member 100 and a lower frame member 102 are coupled to the mounting elements 40 by means of the pins 48 and 50 in a manner similar to that of the upper and lower frame members 44 and 46. A boss 104 is formed on the outward end of the upper frame member 100 and contains a threaded hole 70 arranged substantially parallel with the axis 34 for receiving the shank 66 of a stud 60. Similarly, a boss 106 is formed on the outward end of the lower frame member 102 and contains a pair of spaced threaded holes 70 arranged substantially parallel with the axis 34 for receiving the shank 66 of a pair of studs 60. When the handles 38 are in their closed position, as shown in FIGS. 7 and 8, the spacing of the holes 70 and thereby the installed studs 60, is identical to the spacing of the holes 70 in the tool 30 as shown in FIG. 5. In all other respects, the tool of the second embodiment is similar to the tool 30 of the first embodiment.

Figure 1:
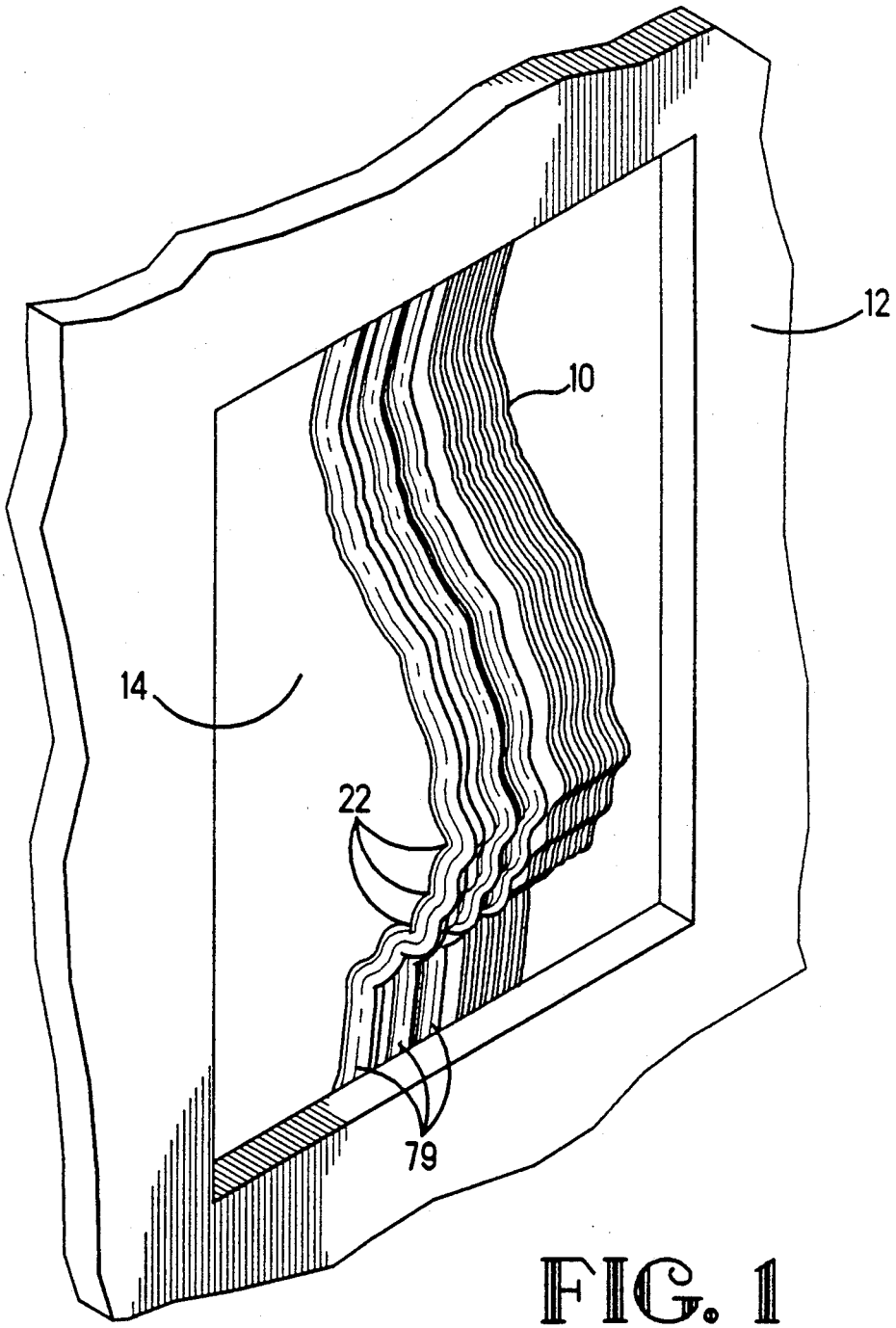
FIG. 1 is an isometric view of a ribbon cable disposed in a wall opening, the cable having kinds which can be flattened by using a tool according to the present invention.
Figure 2:
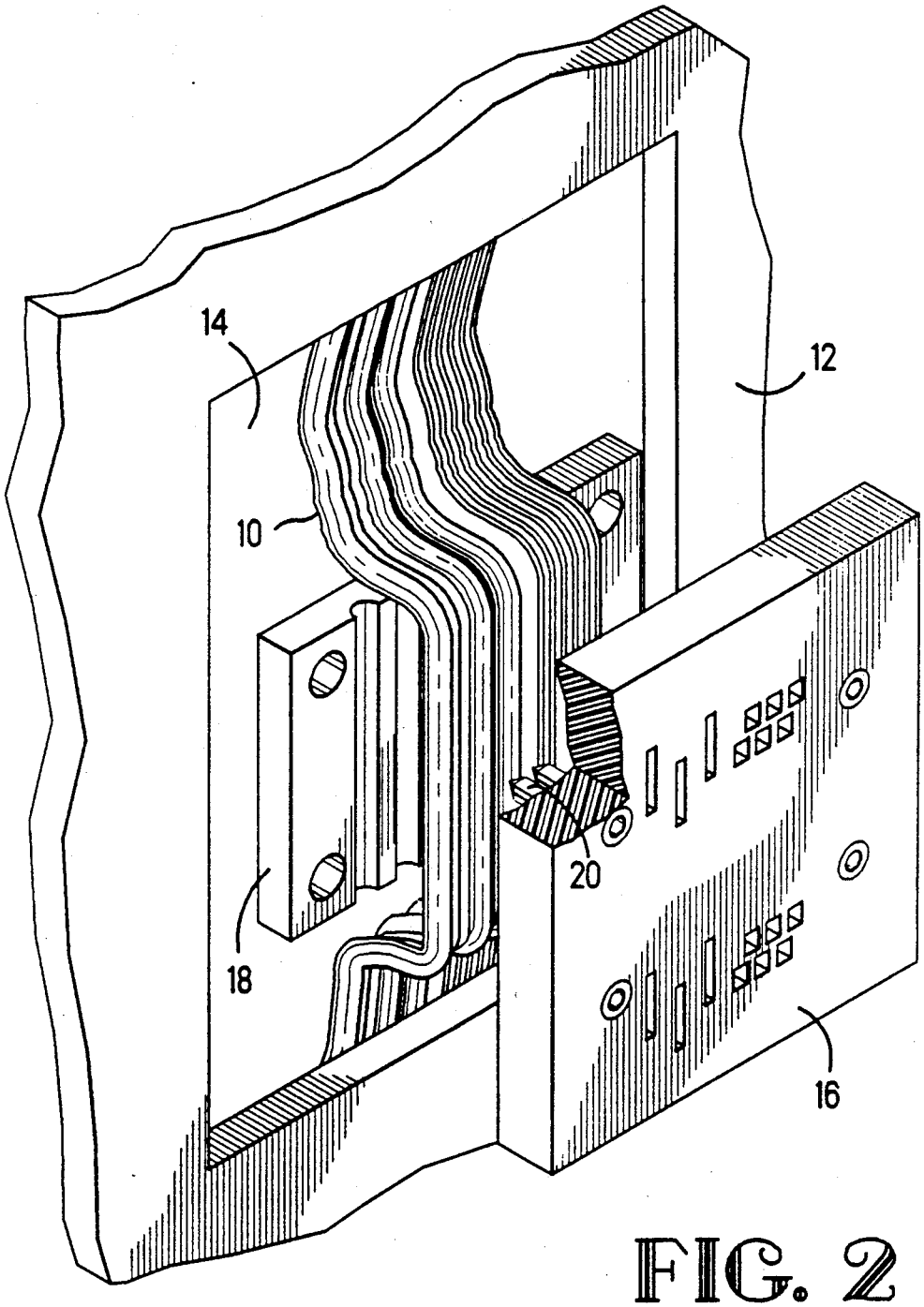
FIG. 2 is an isometric view of the ribbon cable of FIG. 1 after being flattened with a tool according to the invention, and an electrical connector for the ribbon cable.

In operation, the cable 10, as shown in FIG. 1, is manually extended from the interior of the wall 12 outwardly through the opening 14 and arranged with a portion of the cable easily accessible. The tool 30 is then opened, as shown in FIG. 3, and placed about the cable 10 so that the large gage conductors 79 are in alignment with the grooves 77 and the small gage conductors are facing away from the tool 30. The handles 38 are then manually closed to cause the rollers 74 and 82 to operationally engage the cable 10, as best seen in FIG. 5. The hub 84 and pin 88 are then grasped and twisted, first in one direction and then in the other, while varying the pressure on the handles 38. Through such manipulation of the rollers 74, 82 and the handles 38, the kinks 22, as shown in FIG. 1, may be effectively and efficiently removed resulting in a substantially flat area of the cable 10, as shown in FIG. 2. The cable tap 16 and clamp 18 may then be installed in the usual manner.

It will be understood by those skilled in the art that the mounting elements 40 may be extended somewhat and the threaded holes 70 may be formed therein, eliminating the need for the upper and lower frame members 44, 46, 100, and 102. Such a structure will not benefit from the parallel motion afforded to the rollers 74 and 82 of the tool 30. However such a structure may be advantageously utilized to practice the teachings of the present invention if the mechanism is arranged so that the rollers 74 and 82 are parallel when the tool is in its closed position as shown in FIG. 7. Another variation of the tool 30 is the use of smooth surfaced rollers 74 without the grooves 77. In any case it may be advantageous to knurl the surface 80 of at least the roller 82 and perhaps the surface of the rollers 74 as well to gain better traction with the cable 10. In certain applications it may be desirable that the rollers 74 are fixed so that they do not rotate.

An important advantage of the present invention is that kinks in relatively heavy gage conductors of ribbon cables can be easily and effectively flattened to permit the reliable installation of a cable tap. The tool to do this is compact, easily portable, economical to make and use, and is quite effective.

We claim:

1. A tool for straightening a ribbon cable having a plurality of electrical conductors therein, comprising:

a first member including a first stud and a first roller journaled for rotation with respect to said first stud, the first roller having a surface defining a plurality of circumferential grooves spaced to substantially match the spacing of at least some of said plurality of conductors, said surface of said first roller being engageable with one side of said ribbon cable;

a second member including a pair of spaced second and third studs and a pair of section and third rollers journalled for rotation with respect to said second and thirds studs, respectively, the second and third rollers each having a surface defining a plurality of circumferential grooves spaced to substantially match the spacing of said grooves in said first roller, said surfaces of said second and third rollers being engageable with an opposite side of said ribbon cable;

actuating means for moving said first and second members between an open position wherein said first, second and third rollers are disengaged from said ribbon cable, and a closed position wherein axes of rotation of said first, second and third rollers are mutually parallel, said first roller is in said engagement with said one side of said ribbon cable, said second and third rollers are in said engagement with said other side of said ribbon cable, and said grooves of said first, second and third rollers are in substantial alignment; and, means for effecting said rotation of said first rollers;

wherein when said first and second members are in the closed position, said rotation of said first roller causes movement of said ribbon cable between said first roller and said second and third rollers, and said grooves of said first, second third rollers track along their respective conductors to effect straightening of the conductors.

2. The tool according to claim 1, wherein said actuating means has a longitudinal axis and includes a pair of plier members mutually pivotally attached and extending in one direction generally along said longitudinal axis to form a pair of manually operable handles and extending in the opposite direction along said axis to form a pair of mutually opposed mounting elements, wherein said first member is coupled to one of said pair of mounting elements and said second member is coupled to the other of said pair of mounting elements.

3. The tool according to claim 2, wherein said axes of rotation of said first, second and third rollers are substantially parallel with said longitudinal axis.

4. The tool according to claim 2, wherein said axes of rotation of said first, second and third rollers are substantially normal to said longitudinal axis.

5. The tool according to claim 1, wherein said means for effecting rotation comprises a hub extending from said first roller, and a projection extending from said hub.

6. The tool according to claim 1, wherein the surface of each of said first, second and third rollers is knurled adjacent to said grooves defined by said surfaces.

* * * * *

UNITED STATES PATENT AND TRADEMARK OFFICE

CERTIFICATE OF CORRECTION

PATENT NO. : 5,213,139

DATED : May 25, 1993

INVENTOR(S) : Gregory F. Deuel and Kenneth F. Folk

It is certified that error appears in the above-identified patent and that said Letters Patent is hereby corrected as shown below:

Claim 1, line 35, column 2, "section" should be --second--.

Claim 1, line 37, column 2, delete "s" in the word thirds.

Claim 1, line 60, column 2, insert --and-- after the word "second".

Signed and Sealed this

Fifth Day of April, 1994

*Attest:*

*Attesting Officer*

BRUCE LEHMAN

*Commissioner of Patents and Trademarks*